US005907217A

United States Patent [19]

Gorski et al.

[11] Patent Number: 5,907,217

[45] Date of Patent: May 25, 1999

[54] UNI-BIPOTENTIAL SYMMETRICAL BEAM IN-LINE ELECTRON GUN

[75] Inventors: Richard M. Gorski, Arlington Heights; Kenneth A. Guzowski, Hoffman Estates, both of Ill.

[73] Assignee: Zenith Electronics Corporation, Glenview, Ill.

[21] Appl. No.: 08/891,421

[22] Filed: Jul. 9, 1997

[51] Int. Cl.[6] ..... H01J 29/46; H01J 29/56

[52] U.S. Cl. ..... 315/15; 315/382.1; 313/449

[58] Field of Search ..... 315/14, 15, 382, 315/382.1; 313/449

[56] References Cited

U.S. PATENT DOCUMENTS 5,055,749 10/1991 Chen et al. ..... 315/382

5,461,278 10/1995 Misono et al. ..... 313/414

5,625,252 4/1997 Tsuzurahara ..... 313/414

5,675,211 10/1997 Ueda ..... 313/412

*Primary Examiner*—Theodore M. Blum

[57] ABSTRACT

A Uni-Bipotential in-line electron gun for a color cathode ray tube includes a specially shaped G4 electrode for compensating the gun for comatic distortion. In the G4 electrodes the three apertures are oblong in shape, with the two outer apertures being horizontally displaced from the beam axis to inwardly displace the electron beams so that they substantially fall on the respective optical axes of symmetry of the main lens.

4 Claims, 3 Drawing Sheets

UNI-BIPOTENTIAL SYMMETRICAL BEAM IN-LINE ELECTRON GUN

BACKGROUND OF THE INVENTION AND PRIOR ART

This invention relates generally to in-line electron guns for color cathode ray tubes and specifically to a uni-bipotential in-line electron gun having minimal comatic aberrations.

In-line electron guns for cathode ray tubes are well known in the art. U.S. Pat. No. 5,170,101, assigned to Zenith Electronics Corporations describes an in-line electron gun for use in high resolution tri-beam color cathode ray tubes that have self convergent yokes. As is well known, such yokes undesirably introduce beam shape distortions which, however, may be compensated by various electron lens configurations, one such a being a dynamic lens, often referred to as a Dynamic Quadropole. Other types of distortion are also introduced to the electron beams by the electronic lenses of the gun. A major problem is that of spherical aberration, which is characterized by an increase in focussing power that is proportional to the cube of the radial distance from the optical center of the lens. Thus the outer portion of the beam will be more strongly focussed than the mid portion, and the mid portion more strongly focussed than the center portion, resulting in an aberrated image. To compensate for this distortion, the lenses are made as large as possible, constrained by the electron gun and tube geometry.

Another type of distortion, referred to as comatic distortion, is addressed by the present inventions. Comatic distortion results when the beam is off center of the optical lens axis, that is, the optical axis defined by the electric field of the lens. Comatic distortion, a second order effect, describes a result in which the asymmetric focussing action of the lens causes a tail to appear in the electron spot, compromising the resolution of the cathode ray tube.

This type of aberration is inherent in electron main lens systems referred to as the common or open type where a single large aperture provides part of the focussing action for all three beams passing within. It is readily apparent from symmetry principles that the center beam axis is coincident with the electrical axis of such a main lens and no comatic aberration is generated. However the outer beams, while coincident with the electrical symmetry axis of the main lens in the vertical direction, are generally not coincident with the main lens electrical axis in the horizontal direction and generate a horizontally directed comatic aberration in the outer beams, if not compensated.

In one prior art design using the common lens system, comatic aberration is compensated by placing field corrector electrodes behind the single large apertures forming the main lens. The electrode shapes the electric field such that the electric axis is moved to coincide with that of the beam. This type of corrector electrode has a complex aperture shape that must be very accurately positioned in the gun, making manufacture and assembly difficult.

Another prior art design uses a simple plate with three circular apertures to provide some degree of comatic correction by reducing the diameters so that more focussing action is done by the circular apertures and less by the large single common lens aperture. However, in order to achieve a reasonable amount of correction for comatic aberration, the circular diameter must be decreased to the point where spherical aberration increases. Thus this type of design results in a compromise between comatic aberration and spherical aberration.

In the present invention the diameters of the previously described circular apertures of the corrector electrode are maximized so that their size is restricted only by the physical requirement of having three complete circular apertures. Thus the problem of increased spherical aberration is eliminated. This however causes the electric axis of the main lens to be non-coincident with beam axis and results in comatic aberration. In the present invention this comatic aberration is eliminated by deflecting the beam upstream of the main lens area by offsetting the center of one or more outer beam apertures in the pre-focus region of the gun. The amount and direction of the deflection is chosen so that the outer beams will arrive at the main lens area aligned with the electrical axis of the main lens and thus incur little comatic aberration.

Therefore the present invention retains the manufacturability of the circular aperture corrector electrode while providing a high degree of comatic correction and a low degree of spherical aberration.

OBJECTS OF THE INVENTION

A principal object of the invention is to provide a novel in-line electron gun.

Another object of the invention is to provide an in-line electron gun that compensates for comatic aberration.

A further object of the invention is to provide an improved low cost in-line electron gun that compensates for comatic aberration.

BRIEF DESCRIPTION OF THE DRAWINGS

These and other objects and advantages of the invention will become apparent by reading the following description thereof in conjunction with the drawings, in which.

DESCRIPTION OF THE PREFERRED EMBODIMENT

Figure 1:
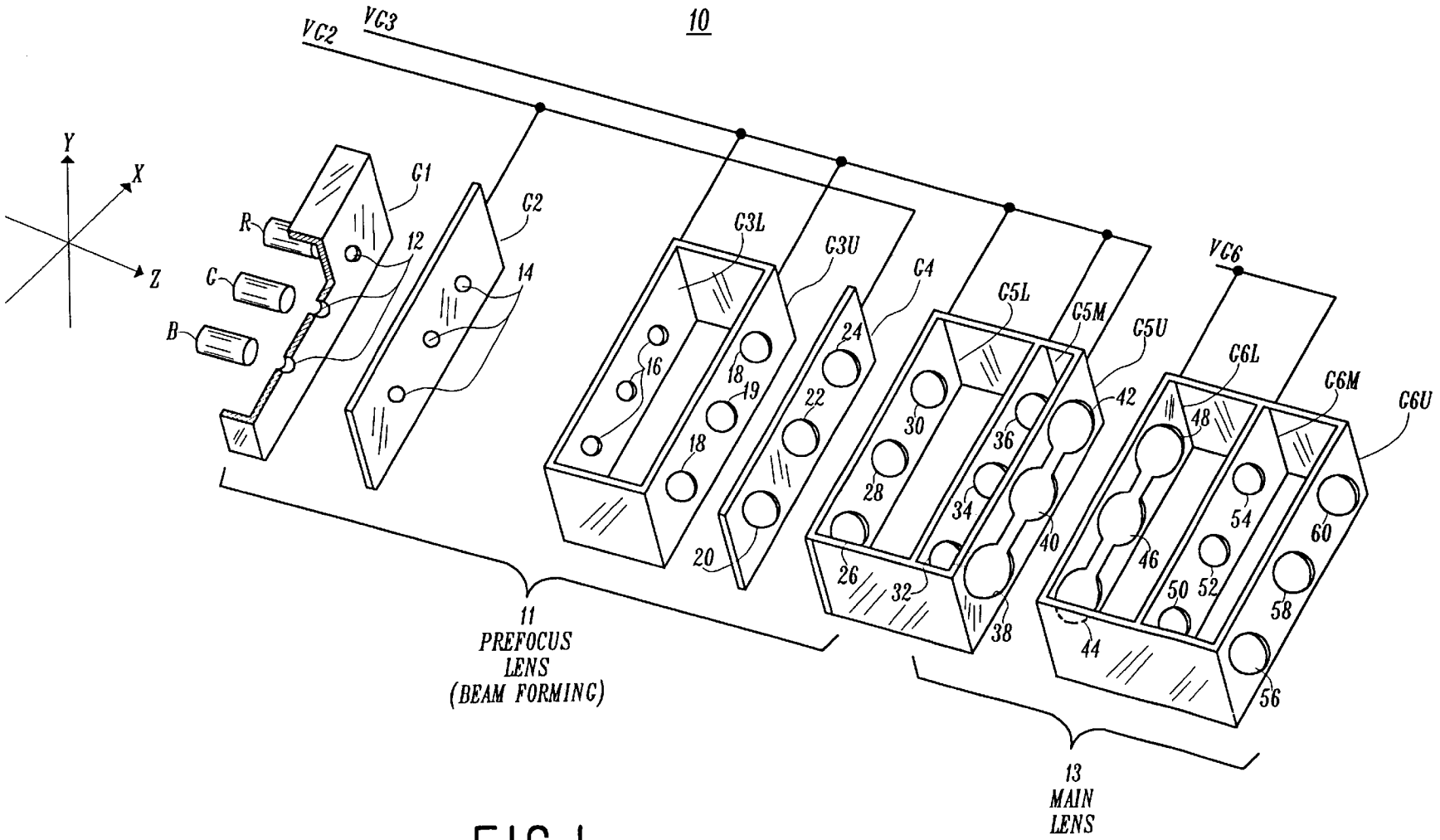
FIG. 1 is an exploded perspective view of a portion of an in-line electron gun constructed in accordance with the invention.

Referring to FIG. 1 of the drawings, an exploded view of a portion of an in-line electron gun 10, constructed in accordance with the invention, is shown. An axes reference, indicating "x", "y" and "z" directions, is shown to the left of the electron gun. Three in-line cathodes, R (red), G (green) and B (blue) develop free electrons that pass through the three small, identical apertures 12 in a G1 control electrodes. A G2 accelerating electrode is positioned adjacent to the G1 electrode and includes three similar sized apertures 14 that are in alignment with corresponding ones of apertures 12 in the G1 electrodes. A G3L (lower) and a G3U (upper) electrode, each having larger diameter apertures 16 and 18, respectively, are positioned in alignment with the G1 and G2 electrodes. The center aperture 19 of G3U is slightly smaller in diameter than the outer apertures 18. The terms "upper" and "lower" are used with respect to the cathode end of the electron gun. It should be understood therefore that the G3L electrode is closer to the G2 electrode than the G3U electrode. A G4 electrode, having three apertures 20, 22 and 24, shaped in accordance with the invention, along with a G5L electrode, completes the beam forming or prefocus lens 11 of electron gun 10.

Figure 2:
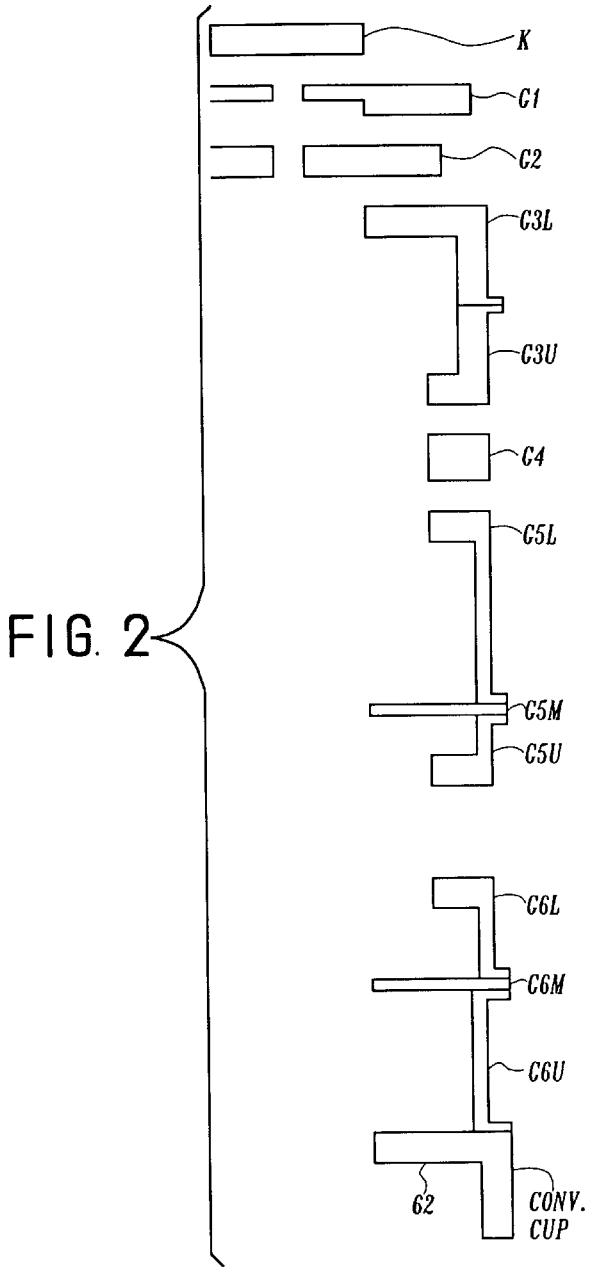
FIG. 2 illustrates the arrangement of the electrodes in one of the electron guns of the invention.

The remainder of the G5 electrode arrangement, consisting of a middle electrode G5M and an upper electrode G5U, and a G6 electrode arrangement, having lower, middle and upper electrodes, comprise the main lens assembly 13. The general positioning of these electrodes is shown in more detail in FIG. 2, which represents a top sectional view of the R electron gun assembly.

Figure 3:
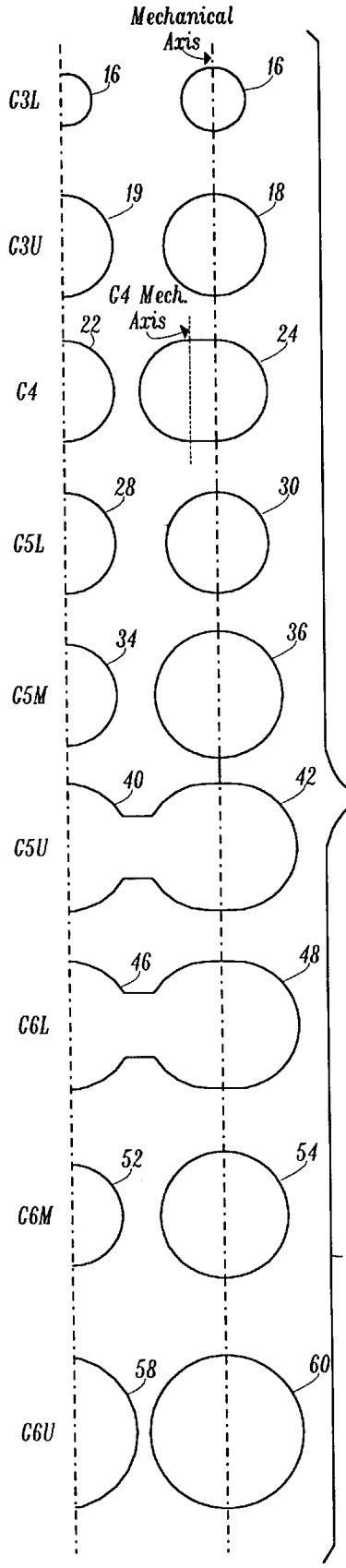
FIG. 3 depicts the configuration of the apertures in the electrodes of the electron gun of FIG. 2.

FIG. 3 depicts the shapes of the various apertures in the electrodes. Only the R electrodes and one-half of the G (green) electrodes are shown because the in-line electron gun is symmetrical about the axis of the center (green) electron gun.

Figure 4:
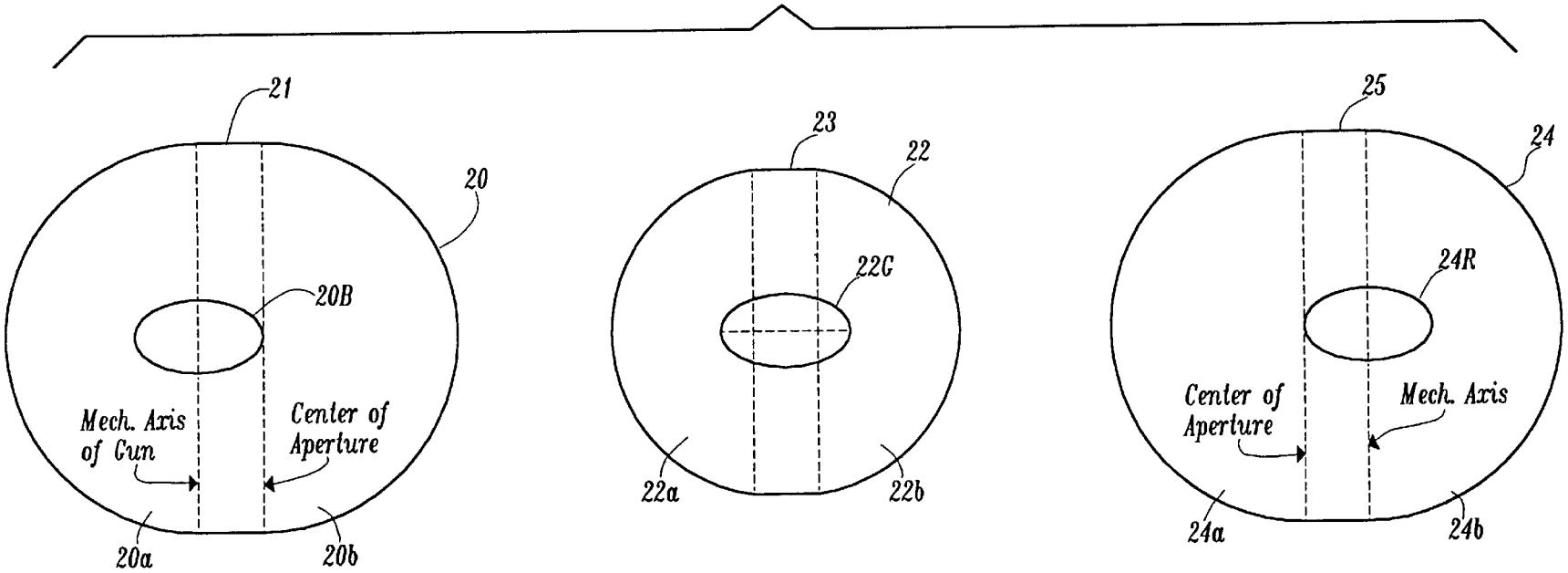
FIG. 4 is a front view of the G4 electrode of the electron gun of the inventions.

In FIG. 4, an enlarged view of the apertures 20, 22, and 24 of the G4 electrode is shown, with the positions of the three electron beams 20B, 22G and 24R illustrated therein, respectively. The large outer apertures 20 and 24 are generally oblong shaped and include approximately rectangular central portions 21 and 25, and semicircular outer portions 20*a*,20*b* and 24*a*,24*b*, respectively. The center aperture 22 is similar in shape but smaller than the outer apertures 20 and 24.

The electrodes are conventionally secured at their opposed ends by means of elongated glass support rails (not shown) and lie in planes that are parallel to the plane of the x-y axis and spaced along the z axis. By way of illustration, apertures 12 and 14 in the G1 and G2 electrodes, respectively, have a diameter of 25 mils (thousandths of an inch) and an S spacing of 260 mils. The S spacing is the distance between the centers of the apertures taken along the x axis. The G1 and G2 electrodes are spaced at least 7 mils apart along the z axis. The G3L electrode is spaced 33 mils from G2 and its apertures 16 each has a diameter of 60 mils. The G3U electrode is welded to the G3L electrode and its outer apertures 18 have a 90 mils radius and its center aperture 19 has an 89 mils radius.

The oblong shaped outer apertures 20 and 24 of the G4 electrode, as discussed above, are formed by pairs of generally semicircular portions 20*a*,20*b* and 24*a*,24*b*, respectively, of 90 mils radius joined by an 8 mils by 180 mils rectangular central portions 21 and 25, respectively. The outer portions 22*a*,22*b* of oblong shaped center aperture 22 each have a radius of 89 mils and the central rectangular portion 23 is 178 mils by 6 mils wide.

The G5 electrode consists of a G5L, a G5M and a G5U electrode that are all welded together (and hence experience the same potential). The G5L electrode outer circular apertures 26 and 30 have 90 mils radii and center circular aperture 28 has an 89 mils radius. The G4 electrode is spaced by 35 mils from each of the G3U and G5L electrodes along the z axis, Each G5M outer aperture 32 and 36 has a 105 mils radius whereas its center aperture 34 has an 87 mils radius.

The z axis spacing between G5U and G6L is 50 mils. The G6 electrode consists of a G6Lm, a G6M and a spacer element (G6U) that are welded together (along with the convergence cup) The G6M apertures 50, 52 and 54 are the same size as the corresponding apertures 32, 34 and 36 of the G5M electrode. The G5U and G6L electrodes have chain link apertures, with the radius of the outer apertures 38 and 42 being 154 mils for G5U and the radius of the outer apertures 44 and 48 for G6L being 146 mils, with S spacings of 228 and 230 mils, respectively. The convergence cup 62 (not shown in FIGS. 1 and 3) has circular apertures of 105 mils radius and S spacings of 260 mils. The G2 and G4 electrodes are electrically connected together, as are the G3 and G5 electrodes.

As best seen in FIG. 4, the oblong shapes of the outer apertures 20 and 24 of the G4 electrode in prefocus lens 11 develop an inwardly directed force on the electron beams 20B and 24R, respectively, that pass therethrough and results in the electron beams being deflected slightly to coincide with the symmetrical optical axes of the corresponding apertures in main lens electrodes G5L, G5M, G5U, G6L, G6M and G6U. In so doing, the comatic aberration that would normally occur due to the beams not being coincident with the axes of symmetry of the main lens electrodes is obviated. Since the oblong shapes of the apertures also introduce some astigmatism, the center aperture 22 of the G4 electrode is similarly shaped to essentially expose the three electron beams to the same environment.

What has been described is a novel uni-bipotential in-line electron gun that is corrected for comatic aberration. It is recognized that numerous changes in the described embodiment of the invention will be apparent to those skilled in the art without departing from its true spirit and scope. The invention is to be limited only as defined in the claims.

What is claimed is:

1. An in-line electron gun for a cathode ray tube comprising:

a G1 electrode and a G2 electrode;

a prefocus lens including G3, G4 and G5L electrodes, each of said electrodes including separate apertures for respectively forming, accelerating and controlling three electron beams, said G2 electrode and said G4 electrode being connected together and to a first DC potential;

a main lens, including G5M, G5U and G6 electrodes each having an aperture for said three electron beams, said G3 electrode and all of said G5 electrodes being connected together and to a second DC potential;

said apertures in said G5 and G6 electrodes, forming a main lens for each of said three beams, and having an optical axis of symmetry;

the outer ones of said three electron beams being displaced in said prefocus lens from said respective axes of symmetry in said main lens; and the outer ones of said apertures in said G4 electrode being oblong in shape for establishing electric fields therein for imparting inwardly directed forces on said outer electron beams, respectively, to substantially center said outer beams on said respective optical axes of symmetry of said main lens to thereby reduce comatic aberration.

2. The electron gun of claim 1, wherein said outer G4 electrode apertures are formed by pairs of generally semicircular portions joined by generally rectangular central portions.

3. The electron gun of claim 2, wherein said semicircular portions are about 90 mils in radius and said rectangular portions are about 180 mils by 8 mils.

4. The electron gun of claim 3, wherein the inner aperture of said G4 electrode includes generally semicircular portions of 89 mils radius and a central rectangular portion of about 178 mils by 6 mils.

* * * * *